United States Patent [19]

Lundmark

[11] Patent Number: 4,583,575

[45] Date of Patent: Apr. 22, 1986

[54] WEAR MEANS FOR DRUM BARKER

[75] Inventor: Lorentz Lundmark, Ersmark, Sweden

[73] Assignee: Skega AB, Ersmark, Sweden

[21] Appl. No.: 651,314

[22] Filed: Sep. 17, 1984

[30] Foreign Application Priority Data

Sep. 30, 1983 [SE] Sweden ..... 8305367

[51] Int. Cl.[4] ..... B02C 17/22

[52] U.S. Cl. ..... 144/208 B; 241/183

[58] Field of Search ..... 241/183, 182, 102; 144/208 R, 208 B

[56] References Cited

U.S. PATENT DOCUMENTS 1,207,174 12/1916 Johnson ..... 241/183

1,986,530 1/1935 Read ..... 241/183

4,293,014 10/1981 Lundmark ..... 144/208 B

*Primary Examiner*—W. D. Bray

*Attorney, Agent, or Firm*—Cushman, Darby & Cushman

[57] ABSTRACT

This invention relates to a wear means, which is arranged within a rotary drum barker as a wear protection of the drum mantle and is connected with this by means of a bolt joint. In rotary drum barkers the regions, where discharge openings for the bark are arranged, are subjected to a heavy wear. Therefore the wear means of the invention are preferably arranged in these areas. What characterizes the wear means of the invention is that it includes a wear body (4) of wear-resistant rubber and a prestressing means (13) which is connected to the wear body (4) so that it absorbs forces. Moreover, the wear means has a sleeve-shaped central portion (15) in connection with the prestressing means (13), the central portion (15) extending into a hole (17) in the drum mantle (1) of a bolt (6) included in the bolt joint and surrounding this.

8 Claims, 4 Drawing Figures

WEAR MEANS FOR DRUM BARKER

This invention relates to a wear means consisting of an elastomeric material, e.g. wear-resistant rubber, arranged within a rotary drum barker as a wear protection of the drum mantle and connected with this by means of a bolt joint.

At known rotary drum barkers a number of so-called lifters are arranged on the inside of the mantle surface, which run lengthwise of the drum barker, i.e. along the rotary shaft of the drum. These lifters usually consist of ribs or the like, which ensure a perfect rotation of the logs, barking being carried out when the logs are rotating against each other. In certain areas of the mantle surface of the drum barker no lifters are arranged, and in these areas discharge openings for the bark are disposed. These have usually the shape of elliptical slots which may be somewhat inclined relative to the rotary shaft of the drum barker. The bark coming loose from the logs at their rotation against each other is discharged through these openings.

One disadvantage of these known drum barkers is that the mantle surface in the regions with openings for bark discharge is subjected to a relatively great wear. This means that these regions have a shorter life than the rest of the drum which is not satisfactory from a constructive and economical point of view.

The object of the invention is realized by means of a wear means of the kind mentioned above which has been provided with the characteristic features defined in the appended claims. The wear protection of the invention is so anchored that the risk of the mounting bolts of the wear means being sheared off is practically eliminated.

Figure 1:
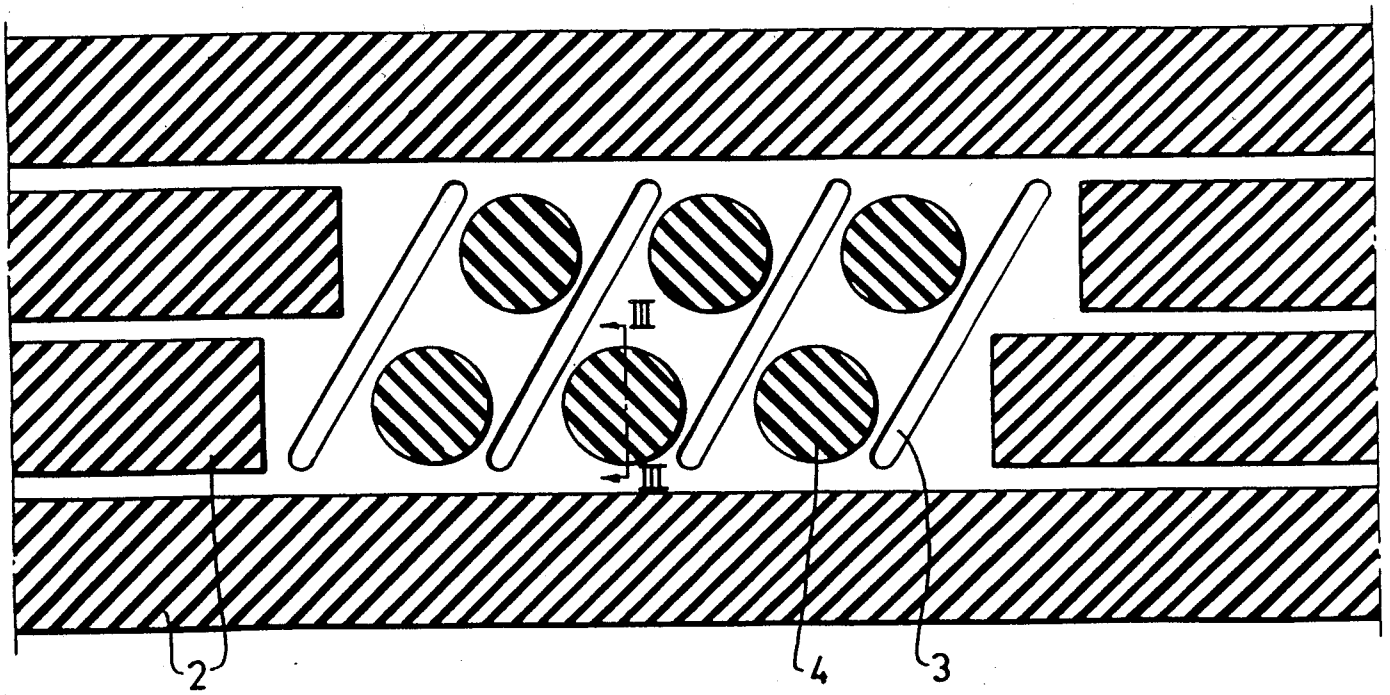
Figure 2:
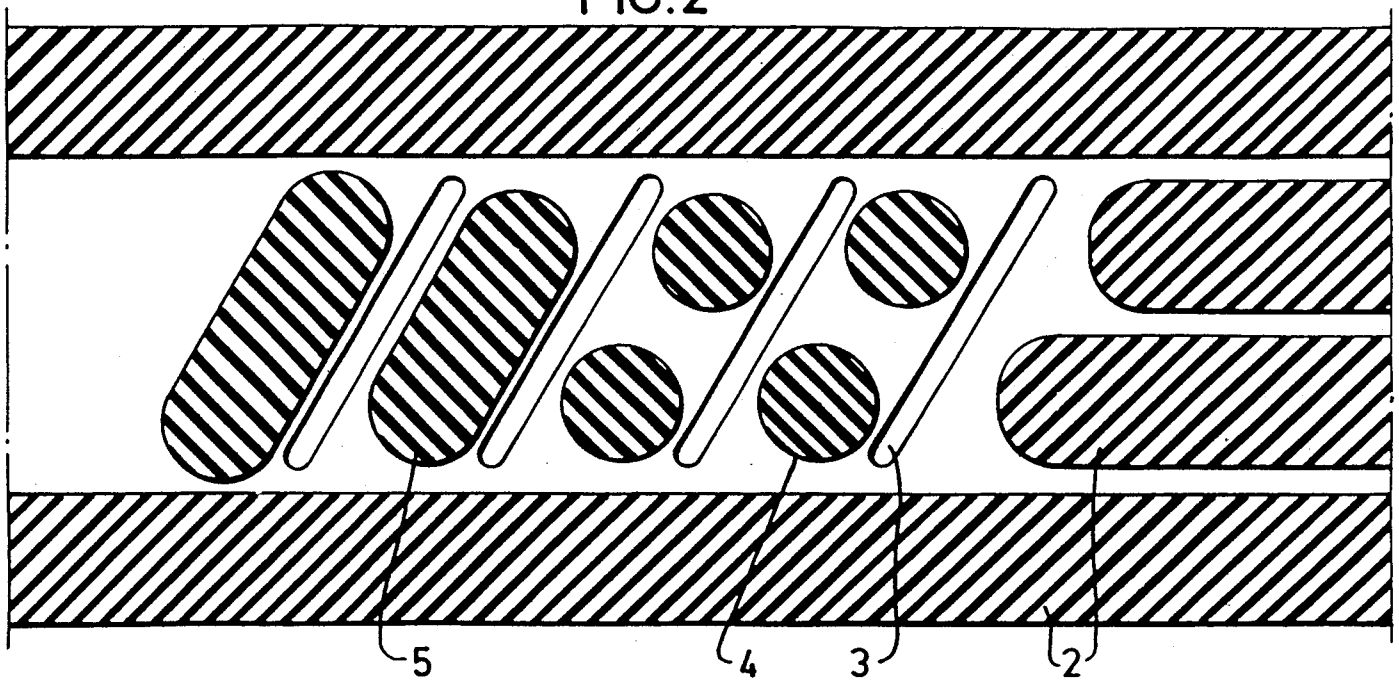
Figure 4:
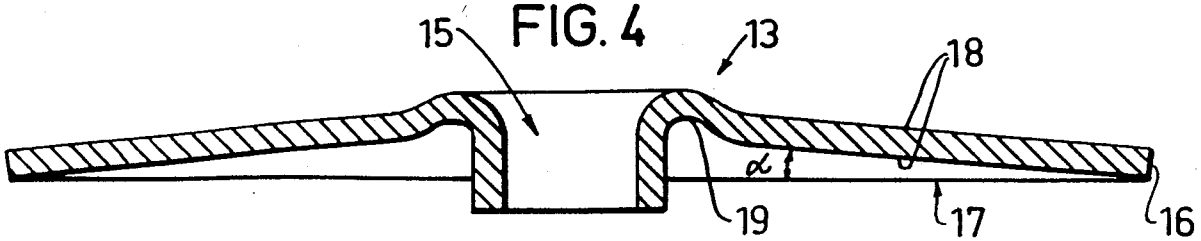
Figure 3:
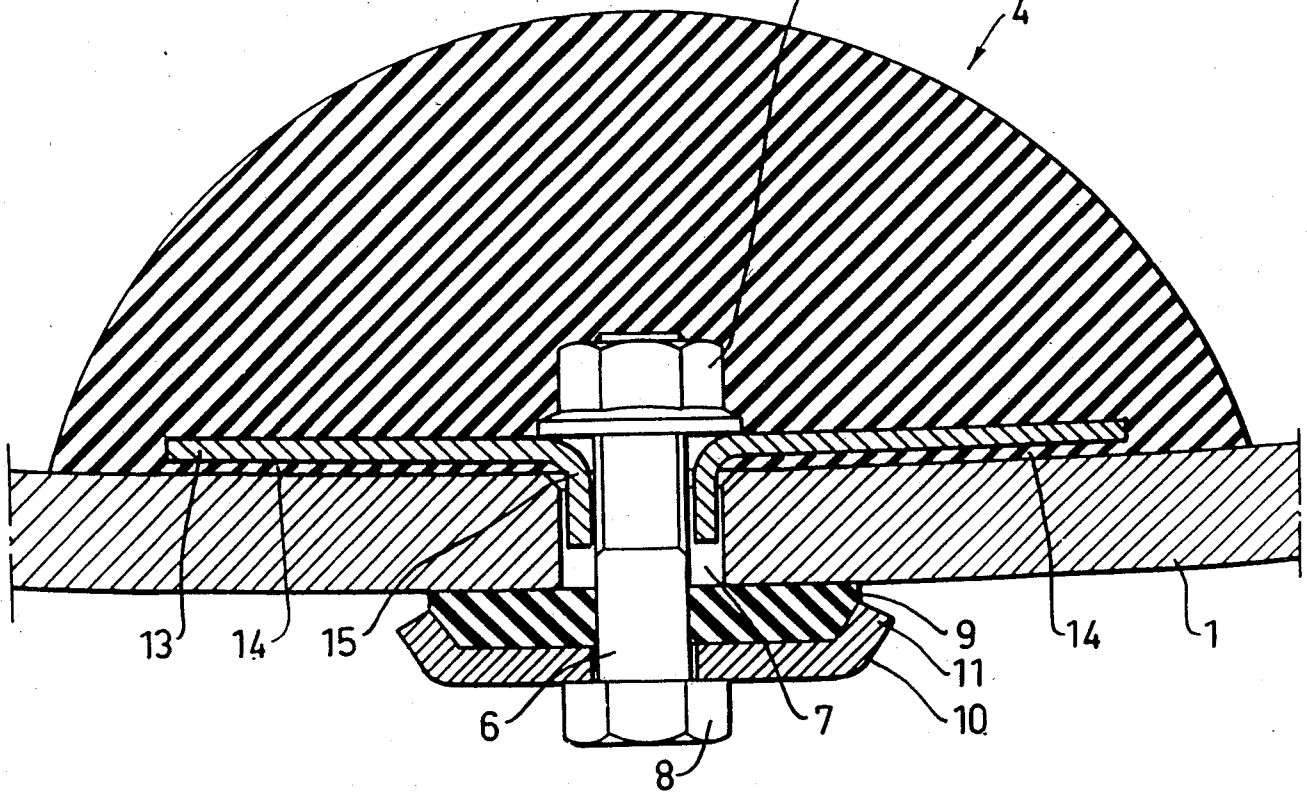

The invention is described in the following with reference to the enclosed drawings in which FIG. 1 shows schematically a section of the mantle of the drum barker with bark discharge openings and wear means according to the invention, as seen from the inside, FIG. 2 shows an alternative embodiment of the mantle of a drum barker according to the invention, FIG. 3 shows a section of a wear means anchored to the drum mantle substantially along the line III—III in FIG. 1 and FIG. 4 shows a section of a prestressing means included in the wear means.

In the drawings 1 designates a mantle of a rotary drum barker, which is provided on its inside with longitudinal barking irons 2 of wear-resistant rubber elements bolted onto the drum mantle 1, said barking irons 2 operating as lifters, or of steel elements with or without wear sleeve of an elastomeric material, said steel elements being bolted onto the drum mantle 1. Between the two lifters or barking irons 2 shown in FIG. 1 openings 3 inclined relative to these are made in the mantle 1 for discharge of bark from the drum. Around these bark discharge openings 3 a number of wear means or wear bodies 4 according to the invention are shown, the main object of which is to protect the drum mantle 1 from wear but also to lead the bark towards the discharge openings as much as possible in order to avoid that bark accumulates and gets stuck about the openings 3 and, finally, clogs these completely or partly.

The wear bodies 4 consisting of an elastomeric material, preferably wear rubber, are shown to have the form of a cap or a spherical segment. The wear bodies 4 can also have another base surface than a circular one, e.g. elliptical, as indicated at 5 in FIG. 2, or rectangular.

Each wear body 4 is bolted onto the drum mantle 1 by means of at least one mounting bolt 6 (at elliptically shaped bodies at least two mounting bolts are used) which extends through a hole 7 in the drum mantle 1 and has on its outside its head or nut bearing against a washer 10 supported by a rubber cushion 9 with an inwardly facing flange 11 running around the periphery completely or partly and enclosing the periphery of the rubber cushion in such a way that there is a distance between flange 11 and drum mantle 1.

In the embodiment of the invention shown in the drawings the nut 12 of the mounting bolt is welded or attached in another way to a prestressing means 13 consisting of spring steel or another equivalent material which has the shape of a washer. The prestressng washer 13 is vulcanized together with the nut 12 in its wear body 4 in such a way that a layer 14 of an elastomeric material which is thin relative to the maximum height of the wear body, covers the side of the washer facing the mantle. In the illustrative example shown this layer has the same thickness across the whole surface of the washer. It is however possible that the layer has a thickness increasing towards the centre of the prestressing washer 13, which has the advantage that if the adhesion between the washer 13 and the layer 14 is released the layer 14 will still be retained in its position between the washer 13 and the drum.

The prestressing washer 13 has a sleeve-shaped central portion 15 with an outside diameter adapted to the hole 7 in the drum mantle 1 of the mounting bolt and an inside diameter adapted to the diameter of the mounting bolt. Moreover, the prestressing washer is so shaped that it has in unloaded state the form of the frustrum of a cone between its periphery 16 and its central portion 15 with an angle $\alpha$ between the base 17 of the cone and the mantle surface 18 which is acute, preferably less than 15° but greater than a couple of degrees. The sleeve-shaped central portion 15 of the washer should have such an extension that it extends in the unloaded state of the washer past a plane coinciding with the base 17 of the cone, as shown in FIG. 4, in order to reach with certainty into the hole 7 of the mounting bolt at mounted wear body 4.

The prestressing washer according to FIG. 4 is drawn up at its central portion. An annular recess 19 is then formed on the underside of the washer 13. Owing to this recess 19 the edges of the hole will not bear against the washer 13 when the washer 13 is in mounted state. At the washer 13 shown in FIG. 3 it has been necessary to bevel the edges of the hole 7 in order to avoid this contact.

When mounting a wear body 4 according to the invention the prestressing washer 13 vulcanized in the wear body will be deformed when the mounting bolt 6 is tightened and be substantially plane or, more exactly, connect onto the slightly curved form of the mantle. In this way the prestressing washer 13 will cause the wear body 4 to be pressed against the drum mantle 1 with the necessary force also at its periphery to prevent bark from penetrating between wear body 4 and drum mantle 1. As the wear body 4 is pressed against the drum mantle 1 with an elastomeric material the friction between wear body 4 and mantle surface will be relatively high and can therefore absorb part of the impulsive forces and other forces to which the wear body is exposed by the logs within the drum barker, the remaining forces being absorbed by the drum mantle 1 via the sleeve-shaped central portion 15 of the prestressing washer. In this way the mounting bolt 6 is not subjected to any shearing strains whatsoever but the mounting bolt need only be dimensioned for the forces required to press the wear body 4 against the drum mantle 1. The rubber cushion 9 located between the drum mantle 1 and the head 8 of the mounting bolt absorbs possibly occurring vibrational forces.

The invention is not restricted to what has been described above and on the drawings but can be changed and modified in several different manners within the scope of the invention defined in the claims. Thus, instead of the nut the head of the mounting bolt can be rigidly connected to the prestressing washer and this can be provided with radial slots for its deformation which extend from the periphery and inwards or from within and outwards. It is also possible that the sleeve-shaped central portion is made as a separate unit, i.e. not integral with the prestressing washer. Moreover, it is possible to provide the wear means of the invention with graters on one side, and such wear means suitably placed relative to each other within the drum mantle can even replace the conventional barking irons.

What I claim is:

1. In a rotary barking drum having a mantle: a wear means as a wear protection of the drum mantle, said wear means being connected to the mantle by means of a bolt joint and comprising a wear body of an elastomeric material, a prestressing means connected in a force-absorbing manner to said wear body and a sleeve-shaped central portion arranged in a force-absorbing connection to said prestressing means, said central portion extending into a hole formed in the drum mantle for a bolt included in said bolt joint and surrounding said bolt and said prestressing means having its side facing the drum mantle covered with a layer of an elastomeric material.

2. Wear means as in claim 1 wherein the prestressing means is combined with the wear body by means of vulcanization.

3. Wear means as in claim 1 wherein the sleeve-shaped central portion is integral with the prestressing means.

4. Wear means as in claim 3 wherein the prestressing means has the shape of a washer which is made as the frustrum of a cone between its periphery and central portion with a relatively small base angle ($\alpha$).

5. Wear means as in claim 1 wherein the layer of elastomeric material on the side of the wear means facing the drum mantle has a thickness increasing towards the central portion.

6. Wear means as in claim 1 wherein the head of the bolt included in the bolt joint is rigidly connected to the prestressing means.

7. Wear means as in claim 1 wherein said bolt joint includes a nut rigidly connected to the prestressing means.

8. In a rotary barking drum having a mantle, a wear means for protecting the inside of said mantle, said wear means including a wear body of elastomeric material having a surface engaging the inside of said mantle, a prestressing annular washer embedded in and vulcanized to said wear body, said washer in an unloaded state having a concave surface facing said mantle and a convex surface facing away from said mantle, a sleeve-shaped member rigidly connected to said washer coaxial with the hole in said washer, said member extending out of said wear body and into a hole in said mantle, said wear body being attached to said mantle by a bolt extending through said hole in said mantle and through said sleeve-shaped member into said wear body, the clamping action of said bolt deforming said washer so as to cause said wear body to be pressed against said mantle with a portion of the wear body lying between said washer and said mantle and said sleeve-shaped member protecting the bolt from shearing strains during operation of said drum.

* * * * *